US006228185B1

(12) United States Patent
Davies et al.

(10) Patent No.: US 6,228,185 B1
(45) **Date of Patent: *May 8, 2001**

(54) METAL MATRIX ALLOYS

(75) Inventors: Peter Davies, Rotherham; James Leslie Frederick Kellie; Douglas Philip Parton, both of Sheffield; John Vivian Wood, Bolnhurst, all of (GB)

(73) Assignee: London & Scandinavian Metallurgical Co., Ltd. (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/980,402

(22) Filed: Nov. 28, 1997

Related U.S. Application Data

(63) Continuation of application No. 08/784,587, filed on Jan. 23, 1997, now abandoned, which is a continuation of application No. 08/601,830, filed on Feb. 15, 1996, now abandoned, which is a continuation of application No. 08/465,944, filed on Jun. 6, 1995, now abandoned, which is a continuation of application No. 08/272,662, filed on Jul. 11, 1994, now abandoned, which is a continuation of application No. 07/928,753, filed on Aug. 13, 1992, now abandoned.

(30) Foreign Application Priority Data

Sep. 9, 1991 (GB) ..... 9119238

(51) Int. Cl.[7] ..... C22C 1/02; C22C 32/00
(52) U.S. Cl. ..... 148/437; 75/684; 75/685
(58) Field of Search ..... 148/437; 75/678, 75/684, 685; 419/12; 420/548, 552, 590

(56) References Cited

U.S. PATENT DOCUMENTS

| | | | | |
|---|---|---|---|---|
| 3,037,857 | | 6/1962 | Conant et al. | 420/379 |
| 3,464,816 | | 9/1969 | Biddulph | 75/135 |
| 3,676,111 | * | 7/1972 | Wieser et al. | 75/684 |

(List continued on next page.)

FOREIGN PATENT DOCUMENTS

| | | | |
|---|---|---|---|
| 0113249 | | 7/1984 | (EP) . |
| 0364381 | | 8/1988 | (EP) . |
| 1470191 | | 2/1966 | (FR) . |
| 0802071 | * | 10/1958 | (GB) . |
| 802071 | * | 10/1958 | (GB) . |
| 1452165 | * | 10/1976 | (GB) . |
| WO8803574 | | 11/1986 | (WO) . |

OTHER PUBLICATIONS

J. Pearson and M. E. J. Birch, "Effect of the Titanium:Boron Ratio on the Efficiency of Aluminium Grain–Refining Alloys," Journal of Metals, Nov. 1979, 27–31.

J. Pearson, M. E. J. Birch and D. Hadlet, "Recent Advances in Aluminium Grain Refinement," Proceedings of the Conference "Solidification Technology in the Foundry and Cast House," held at the University of Warwick, Sep. 15–17 1980, pp. 1–5.

J. Pearson and M. E. J. Birch, "Improved Grain Refining with TiBAI Alloys Containing 3% Titanium," Proceedings of the Conference "Light Metals 1984," held in Los Angeles, CA, Feb. 27, to Mar. 1, 1984, pp. 1217–1229).

(List continued on next page.)

*Primary Examiner*—George Wyszomierski
(74) *Attorney, Agent, or Firm*—Fish & Neave; Jeffrey H. Ingerman; Eric H. Huang

(57) ABSTRACT

The invention provides a process for producing an aluminium-based matrix melt, having boride particles dispersed therein, which is castable, and yet when cast produces a product having a surprisingly good combination of mechanical properties such as stiffness, strength, and elongation at failure. In the process, precursors for boride particles are reacted within an aluminium-based melt to produce boride ceramic particles such as titanium diboride, the process being carried out under conditions such that the melt remains fluid.

15 Claims, 1 Drawing Sheet

U.S. PATENT DOCUMENTS

| | | | | |
|---|---|---|---|---|
| 4,710,348 | * | 12/1987 | Bavpacher et al. | 420/590 |
| 4,751,048 | * | 6/1988 | Christodoulov et al. | 420/590 |
| 4,836,982 | * | 6/1989 | Brupbacher et al. | 420/590 |
| 4,915,903 | * | 4/1990 | Brupbacher et al. | 420/590 |
| 4,915,908 | * | 4/1990 | Nagle et al. | 420/590 |
| 4,985,202 | * | 1/1991 | Moshier et al. | 420/590 |
| 5,055,256 | | 10/1991 | Sigworth et al. | 420/548 |
| 5,057,150 | * | 10/1991 | Reeve et al. | 75/671 |
| 5,708,956 | * | 1/1998 | Dunmead et al. | 419/12 |
| 5,989,310 | * | 11/1999 | Cho et al. | 420/590 |

OTHER PUBLICATIONS

London & Scandinavian Metallurgical Co. Limited Brochure: TiBAL Grain Refiners, Master Alloys And ALTAB Alloying Tablets For Aluminium Industry.

H. Rombout, "Recent Developments in the Grain Refinement of Aluminium by Addition of Master Alloys of the Al–Ti–B Type," Proceedings of the Conference "INCAL 85," pp. 209–218.

F. R. Mollard, W. G. Lidman and J. C. Bailey. "Systematic Selection of the Optimum Grain Refiner," Light Metals 1987 (Proceedings of the Technical Sessions Sponsored by the TMS Light Metal Committee at the 116th Annual Meetings, Denver, Colorado, Feb. 24–26, 1987), pp. 749–755.

D. A. Granger, "Master Alloys; Quality and Performance Expectations of Alcoa," Light Metal Age, Jun. 1987, pp. 17, 20, 22, 24 and 26.

* cited by examiner

METAL MATRIX ALLOYS

This application is a continuation of application Ser. No. 08/784,587, filed Jan. 23, 1997, which is a continuation of application Ser. No. 08/601,830, filed Feb. 15, 1996, which is a continuation of application Ser. No. 08/465,944, filed Jun. 6, 1995, which is a continuation of application Ser. No. 08/272,662, filed Jul. 11, 1994, which is a continuation of application Ser. No. 07/928,753, filed Aug. 13, 1992, all abandoned.

This invention relates to metal matrix alloys, and more specifically to metal matrix alloys comprising an aluminium-based matrix having boride ceramic particles dispersed therein.

It has been previously proposed to incorporate particles of ceramic borides such as titanium diboride into aluminium and its alloys to improve their mechanical properties such as stiffness.

Thus, for example, U.S. Pat. No. 3,037,857 (assigned to Union Carbide) teaches making an aluminium-based metal matrix composite by adding pre-formed particles of a boride such as titanium diboride to aluminium or an aluminium alloy. For relatively low boride particle loadings this may be accomplished by adding them to an aluminium melt at about 1200 degrees C. However, the preferred method taught in U.S. Pat. No. 3,037,857 is to dry blend powders of the boride and of the aluminium-based matrix metal cold, compact the blend at high pressure, and then heat to between 1000 and 1150 degrees C. Pre-formed boride particles are expensive. Also, the known techniques for their production inevitably give rise to impurities on their surfaces. This reduces the ability of the particles to be fully wetted by aluminium-based melts, which will adversely affect the mechanical properties of composites made using them.

European Patent Specification No. 0113249 A (Alcan) describes a method of making a metal matrix composite by producing a relatively low loading of ceramic particles such as boride particles by in situ chemical reaction within a melt of a matrix metal such as aluminium or an aluminium alloy. In the process taught in EP 0113249 A, the melt containing the newly-formed ceramic particles is held at elevated temperatures for a sufficient length of time to cause the particles to form an intergrown ceramic network which is said to increase the mechanical strength of the final product. Production of the network normally requires holding at a temperature of at least 1100 degrees C. for a typical period of 30 minutes, and this treatment results in a dramatic reduction in fluidity, so much so that EP 0113249 A recommends carrying out the operation in a crucible having the appropriate shape of the desired final product.

It has now been discovered that it is possible to produce an aluminium-based matrix melt having boride particles dispersed therein which is castable and yet when cast produces a product having surprisingly good mechanical properties.

According to the present invention, there is provided a process for making a castable aluminium-based matrix melt having boride ceramic particles dispersed therein, the process comprising reacting, within an aluminium-based melt, precursors for the particles, so as to produce boride ceramic particles dispersed in the melt, the process being carried out under conditions such that the melt remains fluid.

Preferably, the flow properties of the melt upon completion of the reaction are such that, at temperatures at which the matrix is molten, the melt is not self-supporting. Those flow properties can be controlled by suitable application of the following principles:

(a) As a result of our experience of working with alloys of the kind with which the invention is concerned, we believe that over-heating can cause a loss of fluidity. Therefore, to maintain the melt in a fluid condition, its temperature should be controlled. Preferably, the temperature within the melt should be maintained below 1000 degrees C. throughout the reaction, and indeed subsequently.

(b) The boride particle loading of the product should not be too high. Generally, it should contain less than 15 weight percent, and preferably from 5 to 10 weight percent, of the dispersed boride ceramic particles. We have found that the maximum boride ceramic particle loading that can be incorporated into the melt without it losing its fluidity can vary with the melt's composition. Thus, for example, in virgin aluminium we have obtained pourable melts with up to 15 weight percent of the dispersed ceramic boride particles, whereas in aluminium-silicon alloys we have achieved only up to 10 weight percent. However, the difference may be due more to the temperature regime to which the melt has been subjected than to its composition.

(c) Although less important, we recommend that the product melt should be cast within 30 minutes, and preferably within 10 minutes, of completion of the reaction, as prolonged holding can cause an increase in melt viscosity, i.e. a loss of fluidity.

(d) We believe that stirring can help prevent loss of fluidity of the melt. We therefore recommend that stirring of the melt should be provided, for example by containing the melt within an induction furnace and operating it to provide an inductive stir.

The boride ceramic particles may be any one or more of those of titanium, zirconium, chromium, tantalum, hafnium, niobium, molybdenum and vanadium, titanium diboride being preferred. It is not necessary for the boride ceramic particles to be chemically pure; they may comprise mixed borides (e.g. more than one metal), for example; also, they may comprise one or more boronitrides, for example. Further, other ceramic particles may be present, in addition to the boride ceramic particles.

The reaction within the aluminium-based melt to produce the ceramic boride particles can be any of the many types of reaction procedures known for the in situ production of boride ceramic particles within an aluminium-based melt; several are outlined in the literature relating to the production of titanium-boron-aluminium grain refiners, and also in EP 0113249. It will be appreciated that the reaction will not be of the SHS (self-propagating high temperature synthesis) type, as with such reactions the reaction product is not in the form of a castable melt.

We prefer that the boride particles should be produced by reacting with aluminium in the melt:

(a) a salt which reacts with aluminium to produce boron; and (b) one or more salts which react with aluminium to produce a boride-forming metal or metals.

Boron produced by reaction of salt (a) with aluminium in the melt will then react with boride-forming metal or metals produced by the reaction of salts(s) (b) with aluminium in the melt, to produce the ceramic boride particles. The reaction can be brought about by feeding, at a controlled rate, a mixture of salts (a) and (b) to the aluminium-based melt, while maintaining stirring of the melt, for example by holding it in a suitably designed and controlled induction furnace. A preferred salt (a) is potassium borofluoride, $KBF_4$. We prefer that salt(s) (b) should be one or more double fluorides of potassium and the boride-forming metal (s).

The aluminium-based melt within which the reaction is carried out may be aluminium or an aluminium alloy.

In accordance with a preferred embodiment of the invention, the boride ceramic particles comprise particles comprising titanium diboride, and we prefer that the weight ratio of titanium to boron in the product should be from 2.5:1 to 2:1, preferably from 2.3:1 to 2.1:1.

The preferred method of performing the preferred embodiment described in the previous paragraph is to produce the boride particles by reacting within the melt potassium borofluoride, $KBF_4$, and a potassium fluorotitanate, preferably potassium hexafluorotitanate, $K_2TiF_6$. The two salts are preferably fed to the aluminium-based melt at a controlled rate, while maintaining stirring of the melt, preferably in the manner described above.

By in situ production of the boride ceramic particles in accordance with the process of the invention, it is possible to produce a castable melt product in which the majority of the boride ceramic particles are less than 1 micron in size, as determined under an optical microscope.

Once the castable melt comprising boride ceramic particles dispersed in metal matrix melt has been produced, it can be cast, by conventional means.

If necessary, the composition of the matrix metal may be adjusted before casting, to give the required final composition. It may be desirable to make such an adjustment of the matrix metal composition in cases where carrying out the boride ceramic particle-forming reaction adversely affects the composition of the matrix metal. For example, in cases where fluoride salts are used to produce the ceramic boride particles as described above, the by-product potassium aluminium fluoride produced will remove any alkali metals or alkaline earth metals present in the aluminium-based matrix metal. If the final aluminium-based metal is to contain such a constituent (magnesium, for example), then it should preferably be omitted entirely from the aluminium-based matrix metal until the reaction has been completed and the by-product fluoride salt removed, and the required amount of alkali metal or alkaline earth metal should then be added prior to casting.

As indicated above, after the reaction has been completed, the temperature should still be prevented from becoming excessive; it should generally be kept below 1000 degrees C. Also, it is undesirable to have too long a period between completion of the reaction and casting; that period should preferably be less than 30 minutes, most preferably less than 10 minutes. We have found that, upon completion of the reaction, the resulting ceramic boride particles are uniformly dispersed throughout the melt, provided that the reaction has been carried out under uniform conditions, as would normally be the case. However, if the above conditions regarding temperature and time between the reaction and casting are not observed, there will be an increasing tendency for the melt to loose its fluidity. For the same reason, we prefer that stirring should be maintained during that period. Provided that the above conditions are observed, the ceramic boride particles in the melt prior to casting will be substantially uniformly dispersed throughout the matrix metal liquid. However, we have found that once the product has been cast, the boride ceramic particles in the resulting solidified product are somewhat inhomogeneously distributed, and that the mechanical properties of the product can be improved by mechanically working the product after casting, for example by extruding it, to cause the ceramic boride particles to become uniformly distributed in the matrix metal once again.

Cast products produced in accordance with the invention can be employed in the fields in which conventional metal matrix composite materials are generally used. A more specialised field in which we envisage that products of the invention may be used is as hard facing alloys, for example as a consumable for arc spraying.

BRIEF DESCRIPTION OF THE DRAWINGS

In order that the invention may be more fully understood, an embodiment in accordance therewith will now be described in the following Example, with reference to the accompanying drawings, wherein.

EXAMPLE

Approximately 20 kg of aluminium was melted in a carbon-bonded silicon carbide crucible by induction heating. At a starting temperature of 660 degrees C. an intimate mixture of $K_2TiF_6$ and $KBF_4$ was fed into the aluminium while stirring the aluminium by induction. The $K_2TiF_6$ and $KBF_4$ salts were in the stoichiometric ratio required to produce titanium diboride, $TiB_2$, ceramic particles.

The exothermic heat of reaction caused the temperature of the melt to rise but was kept below 1000 degrees C. Sufficient salt was reacted to produce a melt of aluminium with approximately 8 weight % $TiB_2$. Potassium aluminium fluoride produced as a by-product of the reaction was removed from the surface of the melt before additions were made to produce a matrix with the composition of a 2014 aluminium alloy, viz., in weight %: 0.8 silicon, 4.4 copper, 0.8 manganese, 0.50 magnesium, balance aluminium and incidental impurities.

Figure 1:
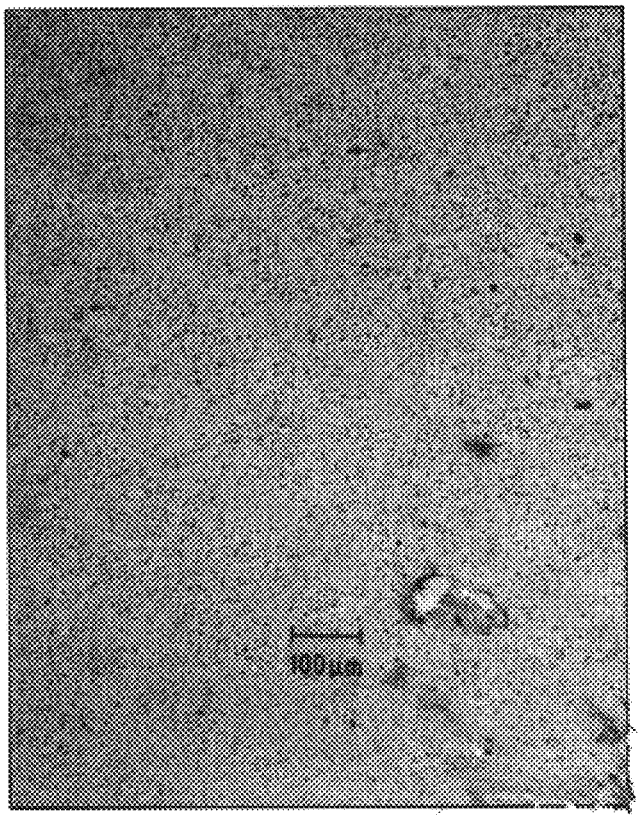
FIG. 1 is a photomicrograph, at a magnification of 100, of the alloy in accordance with the invention produced in the Example.
Figure 2:
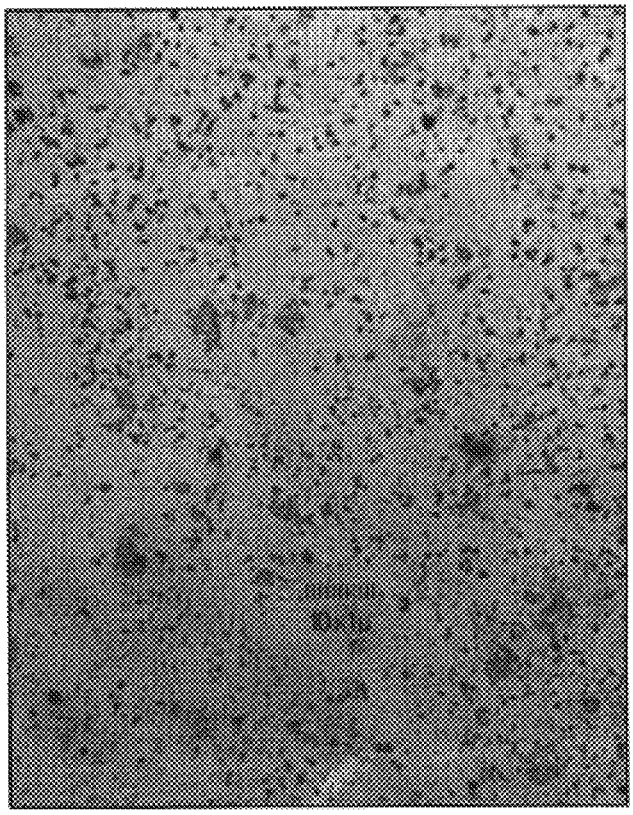
FIG. 2 is a photomicrograph of the same alloy, but at a magnification of 1000.

This alloy was cast to billet and extruded to rod. The microstructure of the alloy, as shown in FIGS. 1 and 2, consists of well dispersed discrete particles of very fine $TiB_2$ particles within an aluminium alloy matrix. Most of these $TiB_2$ particles are below one micron in diameter, as seen in the photomicrographs. Work with a scanning electron microscope has shown the particles to be of generally plate-like shape, typically having a diameter of 2.5 microns or less and a thickness of 0.1 micron.

It has been found that this dispersion of fine $TiB_2$ particles gives rise to particularly advantageous mechanical properties even at the low volume fraction compared with other aluminium metal matrix composites. A comparison of the mechanical properties of solution treated and aged 2014 alloy with and without $TiB_2$ is shown below.

| Properties After Heat Treatment: | | YM GPa | 0.2% PS MPa | UTS MPa | % Elong |
|---|---|---|---|---|---|
| 2014 Alloy | TB | 72.3 | 234 | 405 | 32 |
| | TF | 72.4 | 439 | 491 | 9 |
| 2014 Alloy + 8 wt. % $TiB_2$ | TB | 88.5 | 294 | 493 | 14 |
| | TF | 88.6 | 460 | 510 | 4 |

Key
YM = Young's modulus
0.2% PS = 0.2% proof stress
UTS = ultimate tensile strength
% Elong = percentage elongation at failure
TB = solution treated at 505 degrees C. and naturally aged
TF = solution treated at 505 degrees C. and aged for 24 hours at 160 degrees C.

It can be seen that significant improvements in stiffness and strength have been achieved without the dramatic reduction in ductility that is often associated with other aluminium metal matrix composites. It is also to be expected that the relatively fine size and low volume fraction of $TiB_2$ will improve the ease with which these materials can be machined in comparison with other aluminium metal matrix composites.

What is claimed is:

1. A process for making an aluminum-based metal matrix alloy having titanium diboride ceramic particles dispersed therein comprising, (a) carrying out a reaction within an aluminum-based melt of
  (i) a salt which reacts with aluminum to produce boron; and
  (ii) one or more salts which react with aluminum to produce boride-forming metal;
the weight ratio of titanium to boron in said melt being greater than 2.2:1 and no more than about 2.5:1;
(b) maintaining the temperature of said melt below about 1000° C. throughout said reaction;
(c) carrying out said reaction under conditions such that said melt remains fluid during said reaction; and
(d) casting said melt following said reaction to produce said aluminum-based metal matrix alloy.

2. The process according to claim 1, wherein said aluminum-based metal matrix alloy comprises less than about 15 wt. % of said dispersed titanium diboride ceramic particles.

3. The process according to claim 1, wherein said aluminum-based metal matrix alloy comprises from about 5 wt. % to about 10 wt. % of said dispersed titanium diboride ceramic particles.

4. The process according to claim 1, further comprising stirring said melt.

5. The process according to claim 1, wherein said salt which reacts with aluminum to produce boron comprises potassium borofluoride, $KBF_4$.

6. The process according to claim 1, wherein said one or more salts which react with aluminum to produce boride-forming metal comprises one or more potassium fluorotitanates.

7. The process according to claims 6, wherein said one or more potassium fluorotitanates comprises potassium hexafluorotitanate, $K_2TiF_6$.

8. The process according to claims 1, wherein said weight ratio of titanium to boron is greater than 2.2:1 and no more than about 2.3:1.

9. The process according to claim 1, wherein the majority of said titanium diboride ceramic particles in said cast aluminum metal matrix alloy are less than about 1 micron in size, as determined under an optical microscope.

10. The process according to claim 1, further comprising adjusting the composition of said melt prior to said casting.

11. The process according to claim 1, further comprising casting said melt within about 30 minutes of completion of said reaction.

12. The process according to claim 1, further comprising casting said melt within about 10 minutes of completion of said reaction.

13. The process according to claim 1, further comprising mechanically working said metal matrix alloy following said casting.

14. The process according to claim 13, wherein said mechanically working said metal matrix alloy following casting comprises extruding said metal matrix alloy following casting.

15. An aluminum-based metal matrix alloy having titanium diboride ceramic particles dispersed therein and comprising less than about 15 wt. % of said dispersed titanium diboride ceramic particles, said aluminum-based metal matrix alloy being made by a process comprising, (a) carrying out a reaction within an aluminum-based melt of
  (i) a salt which reacts with aluminum to produce boron; and
  (ii) one or more salts which react with aluminum to produce boride-forming metal;
the weight ratio of titanium to boron in said melt being greater than 2.2:1 and no more than 2.5:1;
(b) maintaining the temperature of said melt below about 1000° C. throughout said reaction;
(c) carrying out said reaction under conditions such that said melt remains fluid during said reaction; and
(d) casting said melt following said reaction to produce said aluminum-based metal matrix alloy.

* * * * *